US007671008B2

(12) United States Patent
Mohammadi

(10) Patent No.: US 7,671,008 B2
(45) Date of Patent: Mar. 2, 2010

(54) FABRIC CONDITIONING COMPOSITIONS

(75) Inventor: Mansur Sultan Mohammadi, Wirral (GB)

(73) Assignee: The Sun Products Corporation, Wilton, CT (US)

( * ) Notice: Subject to any disclaimer, the term of this patent is extended or adjusted under 35 U.S.C. 154(b) by 0 days.

(21) Appl. No.: 12/229,262

(22) Filed: Aug. 21, 2008

(65) Prior Publication Data

US 2009/0054296 A1 Feb. 26, 2009

(30) Foreign Application Priority Data

Aug. 24, 2007 (GB) ..... 0716510.3

(51) Int. Cl.
*C11D 1/645* (2006.01)

(52) U.S. Cl. ..... 510/527; 510/522

(58) Field of Classification Search ..... None
See application file for complete search history.

(56) References Cited

U.S. PATENT DOCUMENTS 5,133,885 A * 7/1992 Contor et al. ..... 510/521
5,545,340 A * 8/1996 Wahl et al. ..... 510/517
5,580,481 A * 12/1996 Sakata et al. ..... 510/527
5,747,443 A * 5/1998 Wahl et al. ..... 510/515
5,773,409 A * 6/1998 Haq et al. ..... 510/521
6,759,383 B2 7/2004 Demeyere et al.
6,794,356 B2 9/2004 Turner et al.
6,927,202 B2 8/2005 Grainger et al.
2009/0054297 A1 2/2009 Mohammadi

FOREIGN PATENT DOCUMENTS

WO WO 03/022973 A1 3/2003
WO WO 2009-027265 A1 3/2009
WO WO 2009-027268 A1 3/2009

OTHER PUBLICATIONS

International Search Report for International Application No. PCT/EP2008/060833, European Patent Office, Netherlands, mailed on Nov. 18, 2008.

* cited by examiner

*Primary Examiner*—John R Hardee
(74) *Attorney, Agent, or Firm*—Sterne, Kessler, Goldstein and Fox, P.L.L.C.

(57) ABSTRACT

The concentrated liquid fabric softening composition of the present invention comprises an ester-linked triethanolamine (TEA) quaternary ammonium fabric softening material having an Iodine Value of between 0 and 60 and comprising a mixture of at mono-, di- and tri-ester linked components; a single long chain cationic surfactant based on quaternized fatty acid amido-amine surfactants with optional ethoxylate groups and preferably having a methylsulphate counter-ion; and a co-fragmenting agent which is a polyol selected from trihydric and polyhydric polyols. The compositions have a desirable pearly appearance which is stable across a range of storage temperatures.

14 Claims, No Drawings

FABRIC CONDITIONING COMPOSITIONS

FIELD OF THE INVENTION

The present invention relates to fabric conditioning compositions. More specifically, the invention relates to pearly cationic fabric softening compositions comprising a linear cationic surfactant and a low molecular weight polyol.

BACKGROUND OF THE INVENTION

Liquid fabric conditioners are compositions that soften fabric. Such compositions are typically contacted with fabric in the rinse cycle of the wash process. Consumers desire an attractive appearance and excellent pourability of such liquids. Non-ionic ethoxylated surfactants with bulky ethoxylate (EO) groups help to make concentrated fabric conditioning compositions pourable. Non-ionic surfactants achieve this low viscosity by fragmenting the spherical liposome droplets into lamellar 'sheets' or disks of flat structure. Such non-spherical structures give the liquid a pearly lustre that is particularly liked by consumers. However, stability problems are known to persist with regard to the storage stability of compositions containing ethoxylate surfactants, particularly relating to optical and Theological aspects. The liquid thickens in the bottle and suffers loss of its pearly lustre. These problems are exacerbated at higher storage temperatures, such as are experienced in warmer climates or when ambient temperature rises. Thickening in the bottle leads to wasted product and, when used in automatic washing machines, messy residues being left in the dispenser draw of the machine. Ultimately this leads to a limited shelf life.

This high temperature stability issue arises from the collapse of the ethoxylate groups at elevated temperature and loss of steric repulsion that these groups afford the lamellar fragments as described in 'Colloids and Surfaces A 288 (2006), 96-102, Colloidal stability of di-chain cationic and ethoxylated non-ionic surfactant mixtures used in fabric softeners'. The fragments adhere together and this size enlargement results in increase in viscosity of the composition and loss of the pearly lustre. At low ambient temperatures ethoxylate surfactants provide acceptable stability to the fragment structures.

Numerous publications disclose ways of improving the high temperature storage stability of liquid fabric softeners stabilised by ethoxylated non-ionic surfactants, for example, EP 523,922 and WO 01/46360.

The effect of ethoxylated nonionics with bulky headgroups on softener compositions is taught in WO 95/27769 where high levels of ethoxylated nonionics can be used to solubilise fabric softeners into micelles or micellar structures. These translucent liquids are claimed to be stable on storage and have good softening, dispensing and dispersing properties. Non-surfactant co-solubilisers such as urea, acid amides, citric acid, polycarboxylic acid, glycerol, sorbitol, sucrose and PEGs of MW~200 to 6000 are mentioned.

WO 95/27771 teaches that amphoteric surfactants including betaines and tegobetaines can also solubilise fabric softeners into micellar structures to produce translucent liquids. Non-surfactant co-solubilisers are mentioned as in WO 95/27769. The compositions can be made either by co-melting of surfactant with softener and then adding to water or by sequential addition of components.

WO 93/23510 discloses the use of highly ethoxylated non-ionic surfactants, cationic surfactants and their mixtures as viscosity/dispersibility modifiers for di-ester quaternary ammonium compounds to produce concentrated liquid compositions with improved-storage stability and viscosity characteristics. An optional liquid carrier can be included that is a mixture of water and low molecular weight solvents such as mono-, di-, tri- and poly-hydric alcohols. The composition is prepared by adding the melt of the softener to a solution of the single chain cationic surfactant.

As mentioned above the use of non-ionic surfactants as viscosity modifiers cause optical and rheological stability problems at elevated ambient temperatures.

We have now found that a combination of a single chain cationic surfactant, which is an amido-amine cationic quaternary ammonium surfactant, with a co-fragmenting agent, such as a polyol, in a concentrated liquid fabric softener composition containing an ester-linked cationic softener compound, unexpectedly gives rise to excellent storage stability of the concentrated fabric softener composition across a range of temperature conditions, including elevated temperatures. The liquid softener composition of the invention does not suffer from excessive thickening and the pearly appearance is preserved. This optical and Theological stability is achieved by compositions prepared using a specific order of mixing of the components, namely by adding a co-melt of the cationic softener and the single chain cationic surfactant into water containing the co-fragmenting agent.

Appearance of the Softener Compositions

Cationic fabric softener compositions form lamellar gel structures. This structure is characterised by stacks of alternate layers of cationic active and water. For electrolyte-free systems the thickness of the water layers could, in theory, be infinite. This means that small concentrations of cationic softener dispersed in water can give rise to a large viscosity or thick dispersion. When the concentration of cationic softener increases further the liquid becomes very thick and difficult to flow (i.e. it forms a gel). Therefore, aqueous liquid cationic fabric softeners with concentrations above ca 8 wt % require the use of a formulation aid.

To reduce the viscosity one needs to reduce the volume occupied by the large spherical cationic softener particles (called liposomes). One way to achieve this is by using micelle-forming surfactants to force the cationic softener to form smaller particles (or "fragments"), thus reducing the phase volume.

The appearance of the cationic fabric conditioner composition is related to its molecular arrangement. Desirable appearance is pearly or clear, whilst fabric conditioners which have a milky or marbled appearance are less luxurious and less desirable. These types of appearance are, for the purposes of this patent, as described below:

Milky: the liquid contains spherical liposome particles of cationic softener, which reflect light back at random giving it a whitish, opaque appearance.

Pearly: As the spherical liposomes are broken down into fragments, the liquid becomes less milky and more pearly. The fragments are tiny sheet-like flakes of liposome, which orient themselves to give a non-random reflection of light and a characteristic pearly appearance. This appearance is highly desirable for cueing a rich and luxurious liquid.

As mentioned earlier a problem with the desirable fragmented pearly liquids created by the use of ethoxylated nonionics is that they are relatively unstable at elevated temperatures. Presence of perfume aggravates this instability and promotes faster thickening.

Clear: As the fragments get smaller and smaller, for example with addition of high levels of nonionic or cationic surfactant the liquid becomes more clear. High levels of solvent has also been used in the past to increase the clarity of these liquids.

Marbled: At elevated temperatures the fragments stick together and become large sheets resulting in the liquid appearance becoming striated with a marble effect. This optical change accompanies the thickening phenomenon where the flow property becomes stringy and undesirable. Such liquids do not disperse well in water.

It is an aim of the present invention to provide fabric conditioner compositions having a stable pearly appearance, which is maintained on storage under a range of temperature conditions.

We have now surprisingly found that the use of amido-amine single chain cationic surfactants in combination with a polyol such as sucrose or glycerol gives a synergistic improvement in stability. The pearly appearance remains unchanged.

DEFINITION OF THE INVENTION

According to a first aspect of the present invention, there is provided a concentrated liquid fabric softening composition comprising:

i) from 10% to 40%, by weight of the total composition, of an ester-linked triethanolamine (TEA) quaternary ammonium fabric softening material comprising a mixture of mono-, di- and tri-ester linked components;

ii) from 0.1% to 20%, by weight of the total composition, of a single long chain cationic surfactant; and iii) from 0.1% to 20%, by weight of the total composition, of a co-fragmenting agent;

wherein the TEA quaternary ammonium fabric softening material contains at least 10% mono-ester (by weight of the quaternary material) and has an Iodine Value of between 0 and 60; the single long chain cationic surfactant is a quaternized amido-amine surfactant and preferably has a methylsulphate counter-ion; and the co-fragmenting agent is a polyol selected from trihydric and polyhydric polyols.

According to a second aspect of the present invention, there is provided a method for the treatment of fabrics comprising contacting fabrics with a liquid fabric softening composition according to the first aspect of the invention or any of the particular variants thereof disclosed in the following description.

According to a third aspect of the present invention, there is provided a method for the manufacture of a concentrated liquid fabric softening composition according to the first aspect of the invention, comprising the steps of (a) preparing a co-melt of from 10% to 40%, by weight of the total composition, of an ester-linked triethanolamine (TEA) quaternary ammonium fabric softening material comprising a mixture of mono-, di- and tri-ester linked components and from 0.1% to 20%, by weight of the total composition of a single chain cationic surfactant, (b) adding the melt of step (a) into water containing 0.1% to 20%, by weight of the total composition, of a co-fragmenting agent, and (c) milling the resulting formulation from 0.5 to 3 times the batch volume, wherein the TEA quaternary ammonium fabric softening material contains at least 10% mono-ester (by weight of the quaternary material) and has an Iodine Value of between 0 and 60, the single long chain cationic surfactant is a quaternized fatty acid amido-amine surfactant and preferably has a methylsulphate counter-ion, and the co-fragmenting agent is a polyol selected from trihydric and polyhydric polyols.

DETAILED DESCRIPTION OF THE INVENTION

The Quaternary Ammonium Fabric Softening Material

The quaternary ammonium fabric softening material for use in compositions of the present invention is an ester-linked triethanolamine (TEA) quaternary ammonium compound comprising a mixture of mono-, di- and tri-ester linked components.

Typically, TEA-based fabric softening compounds comprise a mixture of mono, di- and tri-ester forms of the compound where the di-ester linked component comprises no more than 70% by weight of the fabric softening compound, preferably no more than 60%, e.g. no more than 55%, or even no more than 45% of the fabric softening compound, and at least 10% of the monoester linked component by weight of the fabric softening compound.

A first group of quaternary ammonium compounds (QACs) suitable for use in the present invention is represented by formula (I):

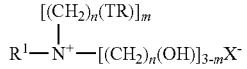

(I)

wherein each R is independently selected from a $C_{5-35}$ alkyl or alkenyl group; $R^1$ represents a $C_{1-4}$ alkyl, $C_{2-4}$ alkenyl or a $C_{1-4}$ hydroxyalkyl group; T is generally O—CO. (i.e. an ester group bound to R via its carbon atom), but may alternatively be CO.O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulphate. Di-esters variants of formula I (i.e. m=2) are preferred and typically have mono- and tri-ester analogues associated with them. Such materials are particularly suitable for use in the present invention.

Especially preferred agents are di-esters of triethanolamine methylsulphate, otherwise referred to as "TEA ester quats.". Commercial examples include Prapagen TQL, ex Clariant, and Tetranyl AHT-1, ex Kao, (both di-[hardened tallow ester] of triethanolamine methylsulphate), AT-1 (di-[tallow ester] of triethanolamine methylsulphate), and L5/90 (di-[palm ester] of triethanolamine methylsulphate), both ex Kao, and Rewoquat WE15 (a di-ester of triethanolamine methylsulphate having fatty acyl residues deriving from $C_{10}$-$C_{20}$ and $C_{16}$-$C_{18}$ unsaturated fatty acids), ex Witco Corporation.

The second group of QACs suitable for use in the invention is represented by formula (II):

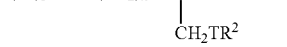

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; and wherein n, T, and $X^-$ are as defined above.

Preferred materials of this second group include 1,2 bis [tallowoyloxy]-3-trimethylamine propane chloride, 1,2 bis

[hardened tallowoyloxy]-3-trimethylamine propane chloride, 1,2-bis[oleoyloxy]-3-trimethylamine propane chloride, and 1,2 bis[stearoyloxy]-3-trimethylamine propane chloride. Such materials are described in U.S. Pat. No. 4,137,180 (Lever Brothers). Preferably, these materials also comprise an amount of the corresponding mono-ester.

A third group of QACs suitable for use in the invention is represented by formula (III):

$$(R^1)_2—N^+—[(CH_2)_n\text{-}T\text{-}R^2]_2\,X^- \quad (III)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above. Preferred materials of this third group include bis(2-tallowoyloxyethyl)dimethyl ammonium chloride and hardened versions thereof.

The iodine value of the quaternary ammonium fabric softening material is from 0 to 60, preferably from 0 to 45, more preferably from 0 to 30, and most preferably from 0 to 20.

Iodine value is defined as the number of grams of iodine absorbed per 100 g of test material. NMR spectroscopy is a suitable technique for determining the iodine value of the softening agents of the present invention, using the method described in *Anal. Chem.,* 34, 1136 (1962) by Johnson and Shoolery and in EP 593,542 (Unilever, 1993).

The softening agent is present in the compositions of the invention at a level of 10% to 40% by weight of the total composition, preferably between 10 to 30%.

The Single Long Chain Cationic Surfactant

The single long chain cationic surfactant of the present invention has a counter ion which is preferably an alkyl sulphate, such as methyl sulphate and ethyl sulphate, and most preferably is a methylsulphate counter-ion.

The long chain cationic surfactants of the invention are based on quaternized amido-amine surfactants of the general structure;

$$R1—C(:O)—NH—[C(R2)(R3)]_n—N(CH_3)(R4)(R5)^+\ X^- \quad (IV)$$

in which R1=C12-30-alkyl, -alkenyl, -arylalkyl, and -(cycloalkyl)alkyl; R2 and R3=H or C1-4-alkyl; R4 and R5=C1-4-alkyl, -alkoxyalkyl, and -hydroxyalkyl; $X^-$ is a halide or methylsulphate anion, preferably a methylsulphate anion counterion and n=1-10

Preferred commercial surfactants include Rewoquat V3351, a tallow alkyl amido-amine methyl sulphate quat (ex Goldschmidt), Surfac ARF, a tallow amine ethoxy ammonium methyl sulphate (ex Surfachem).

The amido-amine single long chain cationic surfactants for use in the present invention may be alkoxylated. These alkoxylated amido-amine single chain cationic surfactants comprise one or more alkylene oxide chains each having less than or equal to about 50 moles alkylene oxide moieties (e.g. ethylene oxide and/or propylene oxide) per mole of amine. The preferred alkoxylated surfactants for use in the present invention comprise at least one ethoxylate group.

The single long chain cationic surfactant preferably comprises one or more ethoxylate groups, preferably from 1 to 20 ethoxylate groups, more preferably from 1 to 12 ethoxylate groups.

The Co-Fragmenting Agent

The co-fragmenting agent is a sugar alcohol also known as a polyol selected from the list consisting of trihydric (e.g. glycerol) and polyhydric polyols. Suitable polyols include monosaccharides and disaccharides, for example, monosaccharides such as glucose and fructose and disaccharides such as sucrose, lactose and maltose. Other suitable polyols include arabitol, erythritol, isomalt, lactitol, maltitol, mannitol, sorbitol and xylitol.

The most preferred polyol co-fragmenting agents are sucrose and glycerol.

The molecular weight of the co-fragmenting agent is preferably less than 600, more preferably less than 500, most preferably less than 400.

Aqueous Continuous Phase

The co-fragmenting agent preferably exists in an aqueous continuous phase. The co-fragmenting agent and water typically comprise less than 90% by weight of the total formulation.

The aqueous continuous phase may also comprise water-soluble species, such as mineral salts or short chain ($C_{1-4}$) alcohols. The mineral salts may aid the attainment of the required phase volume for the composition, as may water soluble organic salts and cationic deflocculating polymers, as described in EP 41,698 A2 (Unilever). Such salts may be present at from 0.001 to 1% and preferably at from 0.005 to 0.1% by weight of the total composition. Examples of suitable mineral salts for this purpose include calcium chloride and magnesium chloride. The compositions of the invention may also contain pH modifiers such as hydrochloric acid. The short chain alcohols include primary alcohols, such as ethanol, propanol, and butanol, and secondary alcohols such as isopropanol. The short chain alcohol may be added with the cationic softening agent during the preparation of the composition.

Perfume

The compositions of the invention typically comprise one or more perfumes. The perfume is preferably present in an amount from 0.01 to 10% by weight, more preferably 0.05 to 5% by weight, most preferably 0.5 to 4.0% by weight, based on the total weight of the composition.

Co-Softener

Co-softeners may be used together with the cationic softening agent. When employed, they are typically present at from 0.1 to 20% and particularly at from 0.5 to 10%, based on the total weight of the composition. Preferred co-softeners include fatty esters, and fatty N-oxides.

Fatty esters that may be employed include fatty monoesters, such as glycerol monostearate, fatty sugar esters, such as those disclosed WO 01/46361 (Unilever).

Further Optional Ingredients

The compositions of the invention may contain one or more other ingredients; such ingredients include preservatives (e.g. bactericides), pH buffering agents, perfume carriers, fluorescers, colourants, hydrotropes, antifoaming agents, anti-redeposition agents, soil-release agents, polyelectrolytes, enzymes, optical brightening agents, anti-shrinking agents, anti-wrinkle agents, anti-spotting agents, anti-oxidants, sunscreens, anti-corrosion agents, drape imparting agents, anti-static agents, encapsulated perfumes, photobleachs, ironing aids and dyes.

The products of the invention preferably do not contain pearlisers and opacifiers. The method of the invention inherently creates a pearly appearance.

The products of the invention preferably do not contain non-ionic surfactant.

Optional Complexing Agent

The compositions of the invention may include a complexing agent. Preferred complexing agents are fatty alcohols and fatty acids.

Such agents typically have a $C_8$ to $C_{22}$ chain present as part of their molecular structure. Suitable fatty complexing agents include $C_8$ to $C_{22}$ fatty alcohols and $C_8$ to $C_{22}$ fatty acids; of these, the $C_8$ to $C_{22}$ fatty alcohols are most preferred. A fatty complexing agent is particularly valuable in compositions comprising a QAC having a single $C_{12-28}$ group connected to the nitrogen head group, such as mono-ester associated with a TEA ester quat or a quaternary ammonium fabric softening material of formula II.

Complexing the single chain QAC may aid the rheological stability of the composition in another manner; the presence of such single chain QACs, particular when present at levels of 10 mole % or greater of the total QAC, can lead to depletion flocculation—addition of a complexing agent has the effect of reducing their free concentration, thereby reducing or eliminating this problem. Enhanced softening performance may also result from the presence of the complex formed between the single chain QAC and the complexing agent.

Preferred fatty acid complexing agents include hardened tallow fatty acid (available as Pristerene, ex Uniqema).

Preferred fatty alcohol complexing agents include hardened tallow alcohol (available as Stenol and Hydrenol, ex Cognis, and Laurex CS, ex Albright and Wilson) and behenyl alcohol, a $C_{22}$ fatty alcohol, available as Lanette 22, ex Henkel.

The fatty complexing agent may be used at from 0.1% to 10%, particularly at from 0.5% to 5%, and especially at from 0.75 to 2% by weight, based on the total weight of the composition.

When a QAC having a single $C_{12-28}$ group connected to the nitrogen head group is present, the mole ratio of the fatty complexing agent to said single chain QAC is preferably from 1:3 to 3:1, more preferably 1:2 to 2:1, and most preferably 2:3 to 3:2.

Product Use

The compositions of the present invention are preferably rinse conditioner compositions and may be used in the rinse cycle of a domestic laundry process.

A method for the treatment of fabrics comprises contacting fabrics with a liquid fabric softening composition according to the invention.

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Method of Manufacture

Formulations according to the invention may be prepared by the method of manufacture described as the third aspect of the invention. The method may comprise the addition of an electrolyte, such as a mineral salt, and/or milling of the formulation. Milling of the formulation, when employed, is typically performed until at least half of the batch volume has passed through the mill, preferably all of the batch volume, most preferably the whole volume is passed through the mill up to three times.

In a typical method of manufacture, the cationic softening agent, cationic surfactant, and any optional components such as co-softener are heated together until a co-melt is formed. Water and co-fragmenting agent are heated and the co-melt is added to the water with stirring. The phase volume of the disperse phase may be reduced by the addition of an electrolyte and/or by milling, preferably whilst the mixture is still hot, while it goes through its phase transition and when it is cold.

One preferred method for the manufacture of a liquid fabric softening composition comprises the steps of (a) preparing a co-melt of from 10% to 40%, by weight of the total composition, of an ester-linked triethanolamine (TEA) quaternary ammonium fabric softening material comprising a mixture of mono-, di- and tri-ester linked components and from 0.1% to 20%, by weight of the total composition of a single chain cationic surfactant, (b) adding the melt of step (a) into water containing 0.1% to 20%, by weight of the total composition, of a co-fragmenting agent, and (c) milling the resulting formulation from 0.5 to 3 times the batch volume, wherein the TEA quaternary ammonium fabric softening material contains at least 10% mono-ester (by weight of the quaternary material) and has an Iodine Value of between 0 and 60; the single long chain cationic surfactant is a quaternized fatty acid amido-amine surfactant and preferably has a methylsulphate counter-ion; and the co-fragmenting agent is a polyol selected from trihydric and polyhydric polyols.

Electrolyte may be added; generally any of the alkaline metals or alkaline earth metal salts of the mineral acids can be used as electrolyte. NaCl, $CaCl_2$, $MgCl_2$ and $MgSO_4$ and similar salts of alkaline and alkaline earth meals are preferred and $CaCl_2$ is especially preferred. The amount of electrolyte will be selected to assure that the composition reaches the viscosity below 500 cps and more preferably 250 cps. Generally, amounts of electrolyte salt needed are from 0.01 to 1.0 wt %, preferably from 0.01 to 0.40 wt %, by weight of the total composition.

EXAMPLES

The invention will now be illustrated by the following non-limiting examples. Further modifications will be apparent to the person skilled in the art.

Examples of the invention are represented by a number. Comparative examples are represented by a letter.

Preparation of Examples 1-4 in Accordance with the Invention, and Comparative Examples A-C 200 ml of liquid fabric softener compositions 1-4, A, B and C were prepared in a stirred vessel at 75° C. as follows: Water and co-fragmenting agent were weighed into the vessel. Softener and surfactant were melted together and added to aqueous co-fragmenting agent with agitation. After 10 minutes the mixing vessel was cooled to 30° C. via recirculation of cold water and the contents transferred to bottles for storage. The resulting compositions are shown in Table 1 below.

TABLE 1

Compositions of the liquid fabric softeners 1-4 and A-C.

| COMPONENTS | A | B | C | 1 | 2 | 3 | 4 |
|---|---|---|---|---|---|---|---|
| CATIONIC SOFTENER | | | | | | | |
| DEEDMAC Kaosoft 98023/4 (Hardened tallow, 85%, ex Kao) | 14.29 | — | 14.29 | 14.29 | — | 14.29 | 14.29 |
| HEQ (S 3956) 78% (Ex Clariant) | — | 13.47 | — | — | 15.47 | — | — |
| SINGLE LONG CHAIN CATIONIC SURFACTANT | | | | | | | |
| Rewoquat V3351, 70% (ex Goldschmidt) | — | — | 1.93 | 1.30 | 1.93 | 1.93 | 4.28 |
| CO-FRAGMENTING AGENT | | | | | | | |
| Glycerol | — | — | — | 2 | 2 | | 2 |
| Sucrose | — | — | — | — | — | 2 | — |
| PEG 2025 | — | — | 2 | — | — | | — |
| Demineralised water | 169 | 169 | 169 | 169 | 169 | 169 | 169 |

The physical properties of the compositions were measured as follows: microstructure was determined by visual assessment using light microscopy, viscosity was measured using a Haake VT 550 viscometer (at 20° C. and shear rates of 20 and 106 1/s), refractive index was measured using a Bellingham and Stanley RFM430 digital refractometer (at 25° C.), conductivity was measured at 25° C. using a LF325conductivity meter from WTW, and pH was measured using a Corning 240 pH meter (at 25° C.)

The results are summarised in Table 2 below.

TABLE 2

Physical properties of the liquid fabric softeners 1-4 and A-C.

| | A | B | C | 1 | 2 | 3 | 4 |
|---|---|---|---|---|---|---|---|
| Microstructure | liposome | Liposome | Fragment/ liposome | Fragment | Fragment | Fragment | fragment |
| Viscosity at 20 1/s (mPa s) | gel | Gel | 250 | 348 | 168 | 170 | 93 |
| Viscosity at 106 1/s (mPa s) | gel | Gel | 84 | 126 | 53 | 87 | 40 |
| Conductivity μS/cm | 800 | 750 | 1706 | 1503 | 1111 | 1196 | 2120 |

It will be seen that the compositions according to the invention have good physical properties. Whilst comparative example C has acceptable viscosity characteristics, it is apparent that the use of PEG 2025 instead of a co-fragmenting agent in accordance with the invention does not lead to a desirable microstructure (dominated by fragments).

Preparation of Examples 5 and 6 in Accordance with the Invention, and Comparative Examples D and E 300 ml of each composition was prepared by co-melting the surfactant and softener together and adding to water containing the dye and preservative (with or without co-fragmentor) at 75° C. under agitation. After 5 minutes extra mixing the batch was cooled to about 30° C. by recirculation of cold water and then perfume was added with 2 minutes extra mixing.

The compositions of the resulting formulations are given in Table 3 below:—

TABLE 3

Compositions of the liquid fabric softeners 5, 6, D and E.

| | D | E | 5 | 6 |
|---|---|---|---|---|
| CATIONIC SOFTENER | | | | |
| TEA quat AHT1 (85%) (Ex Kao) | 13.5 | | 13.5 | |
| HEQ (S 3956) 78% (Ex Clariant) | — | 13.5 | — | 13.5 |
| SINGLE LONG CHAIN FRAGMENTING SURFACTANT | | | | |
| Rewoquat V3351 (70%) (Ex Goldschmidt) | — | — | 1.35 | 1.35 |
| Nonionic coco20EO Genapol C200 (Clariant) | 1.35 | 1.35 | — | — |

TABLE 3-continued

| Compositions of the liquid fabric softeners 5, 6, D and E. | D | E | 5 | 6 |
|---|---|---|---|---|
| CO-FRAGMENTING AGENT | | | | |
| Sucrose | — | — | 1.00 | 1.00 |
| MINORS | | | | |
| Perfume (SL B53 PCMF) (ex Givaudan) | 0.90 | 0.90 | 0.90 | 0.90 |
| Dye (1% solution) Patent Blue V85 | 3 drops | 3 drops | 3 drops | 3 drops |
| Preservative (Proxel GXL, 20% active, ex Arch Chemicals) | 3 drops | 3 drops | 3 drops | 3 drops |
| Demineralised water | Balance to 100 | Balance to 100 | Balance to 100 | Balance to 100 |

The stability of Comparative examples D and E, and of Examples 5 and 6 in accordance with the invention were tested. The results are summarised in Table 5 below.

TABLE 4

| Comparison of the stability of examples in Table 3 at storage temperatures of 4, 25, 37 and 45° C. | Initial | 4 weeks 4° C. | 4 weeks 25° C. | 4 weeks 37° C. | 4 weeks 45° C. |
|---|---|---|---|---|---|
| Comparative Example D | | | | | |
| Viscosity at 20 1/s (mPa s) | 252 | 540 | gel | 347 | 150 |
| Viscosity at 106 1/s (mPa s) | 97 | 132 | gel | 130 | 62 |
| Refractive index | 1.35971 | 1.35975 | 1.36012 | 1.35960 | 1.35891 |
| Conductivity | 520 | 362 | 261 | 263 | 391 |
| pH | 2.37 | 2.54 | 2.62 | 2.81 | 2.84 |
| visual appearance | milky | milky | marbled | marbled | marbled |
| Comparative Example E | | | | | |
| Viscosity at 20 1/s (mPa s) | 160 | 170 | 162 | 450 | 143 |
| Viscosity at 106 1/s (mPa s) | 49 | 55 | 50 | 200 | 55 |
| Refractive Index | 1.36414 | 1.36392 | 1.36422 | 1.36498 | 1.36509 |
| Conductivity | 1150 | 1100 | 1015 | 395 | 951 |
| pH | 2.52 | 2.68 | 2.66 | 2.85 | 2.68 |
| visual appearance | pearly | pearly | pearly | marbled | Marbled |
| Example 5 | | | | | |
| Viscosity at 20 1/s (mPa s) | 430 | 348 | 558 | 237 | 135 |
| Viscosity at 106 1/s (mPa s) | 121 | 130 | 210 | 121 | 61 |
| Refractive index | 1.3609 | 1.36016 | 1.36091 | 1.36062 | 1.36010 |
| Conductivity | 689 | 641 | 584 | 528 | 451 |
| pH | 2.41 | 2.69 | 2.65 | 2.27 | 2.92 |
| visual appearance | pearly | pearly | pearly | pearly | Pearly |
| Example 6 | | | | | |
| Viscosity at 20 1/s (mPa s) | 190 | 223 | 197 | 190 | 141 |
| Viscosity at 106 1/s (mPa s) | 58 | 65 | 57 | 61 | 48 |
| Refractive Index | 1.36658 | 1.36590 | 1.36670 | 1.36640 | 1.36643 |
| Conductivity | 1477 | 1261 | 1237 | 1141 | 1238 |
| pH | 2.92 | 3.01 | 2.94 | 2.98 | 2.81 |
| visual appearance | pearly | pearly | pearly | pearly | Pearly |

The comparison between D and Example 5 and E and Example 6 in Table 4 clearly shows that the compositions of the invention are more stable in both physical and optical characteristics compared to the known nonionic stabilisation route.

What is claimed is:

1. A concentrated liquid fabric softening composition comprising:

(i) from 10% to 40%, by weight of the total composition, of an ester-linked triethanolamine (TEA) quaternary ammonium fabric softening material comprising a mixture of mono-, di- and tri-ester linked components;

(ii) from 0.1% to 20%, by weight of the total composition, of a single long chain cationic surfactant; and (iii) from 0.1% to 20%, by weight of the total composition, of a co-fragmenting agent;

wherein the TEA quaternary ammonium fabric softening material contains at least 10% mono-ester, by weight of the quaternary material, and has an Iodine Value of between 0 and 60; the single long chain cationic surfactant is a quaternized amido-amine surfactant and preferably has a methylsulphate counter-ion; and the co-fragmenting agent is a sugar or a sugar alcohol.

2. A fabric softening composition according to claim 1, wherein the single long chain cationic surfactant comprises one or more ethoxylate groups.

3. A fabric softening composition according to claim 1, wherein the co-fragmenting agent has a molecular weight of less than 500.

4. A fabric softening composition according to claim 1, wherein the sugar or the sugar alcohol is selected from the group consisting of sucrose, lactose, maltose, glucose, and fructose.

5. A fabric softening composition according to claim 4 wherein the sugar is sucrose.

6. A fabric softening composition according to claim 1, wherein the ester-linked triethanolamine quaternary ammonium fabric softening material has an iodine value of from 0 to 45.

7. A fabric softening composition according to claim 1, wherein the ester-linked triethanolamine quaternary ammonium fabric softening material comprises no more than 70% of the di-ester linked component, by weight of the fabric softening compound, and at least 10% of the monoester linked component.

8. A fabric softening composition according to claim 1, wherein the co-fragmenting agent and water comprise less than 90% by weight of the total formulation.

9. A fabric softening composition according to claim 1, which further comprises a fatty complexing agent selected from a fatty alcohol and a fatty acid.

10. A method for the treatment of fabrics comprising contacting fabrics with a liquid fabric softening composition according to claim 1.

11. A method for the manufacture of a concentrated liquid fabric softening composition comprising:

(a) preparing a co-melt of from 10% to 40%, by weight of the total composition, composition, of an ester-linked triethanolamine (TEA) quaternary ammonium fabric softening material comprising a mixture of mono-, di- and tri-ester linked components and from 0.1% to 20%, by weight of the total composition of a single chain cationic surfactant;

(b) adding the melt of (a) into water containing 0.1% to 20%, by weight of the total composition, of a co-fragmenting agent; and (c) milling the resulting formulation from 0.5 to 3 times the batch volume, wherein the TEA quaternary ammonium fabric softening material contains at least 10% mono-ester, by weight of the quaternary material, and has an Iodine Value of between 0 and 60, the single long chain cationic surfactant is a quaternized fatty acid amido-amine surfactant and preferably has a methylsulphate counter-ion, and the co-fragmenting agent is a sugar or a sugar alcohol.

12. A method according to claim 11, which further comprises adding an electrolyte.

13. The method according to claim 11, wherein the sugar or the sugar alcohol is selected from the group consisting of sucrose, lactose, maltose, glucose, and fructose.

14. The method according to claim 11, wherein the sugar is sucrose.

* * * * *